United States Patent [19]

Niccolls

[11] 4,211,053

[45] Jul. 8, 1980

[54] MACHINES FOR APPLYING BAGS OR SACKS TO THE DISCHARGE SPOUTS OF BAG-FILLING MACHINES

[76] Inventor: Peter J. Niccolls, 15c Martlesham Heath, Ipswich, Suffolk, England

[21] Appl. No.: 949,034

[22] Filed: Oct. 6, 1978

[51] Int. Cl.[2] ..... B65B 43/30

[52] U.S. Cl. ..... 53/386; 53/571

[58] Field of Search ..... 53/571, 570, 386

[56] References Cited

U.S. PATENT DOCUMENTS

| | | | |
|---|---|---|---|
| 2,684,191 | 7/1954 | Dolman | 53/571 |
| 2,725,168 | 11/1955 | Lindstaedt et al. | 53/386 X |
| 3,943,687 | 3/1976 | Cerioni | 53/571 |

*Primary Examiner*—Travis S. McGehee

*Attorney, Agent, or Firm*—Brisebois & Kruger

[57] ABSTRACT

A machine for applying a bag to the discharge spout of a bag-filling machine comprises a suction pick-up device for lifting the top bag from a stack of flat bags and turning the bag into a vertical position with its mouth disposed along one vertical edge of the bag, and a suction transfer device for engaging the bag held by the pick-up device, swinging the bag from the pick-up device to the discharge spout and, at the same time, opening the bag mouth so that it slips over the spout. The transfer device comprises opposed suction fingers which engage the bag, when held by the pick-up device, adjacent the upper end of its mouth and are pivotally mounted so as to be rockable apart, and opposed auxiliary suction members which are pivoted to arms rockably mounted on the pivot axes of the suction fingers and which engage the bag adjacent the lower end of its mouth. The suction fingers and auxiliary suction members are together rockable apart to open the bag mouth and form the open bag mouth into a particularly satisfactory configuration for facilitating application to the discharge spout.

11 Claims, 7 Drawing Figures

Fig.4
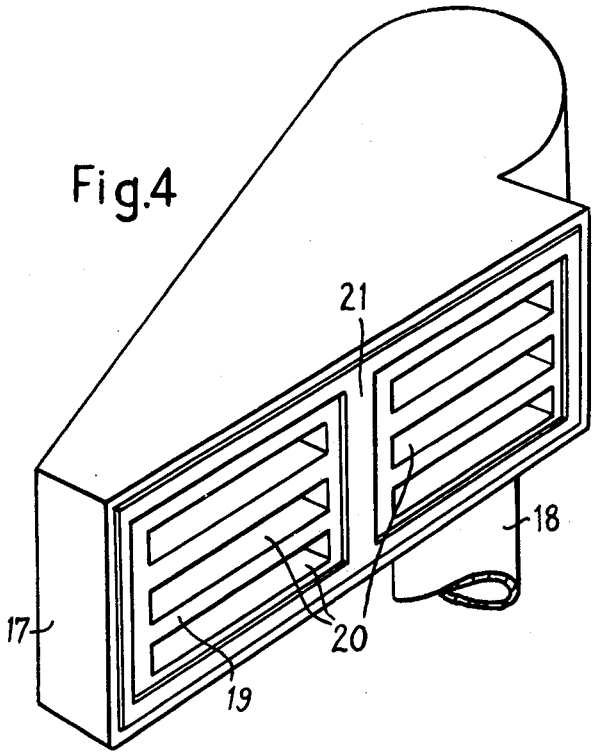
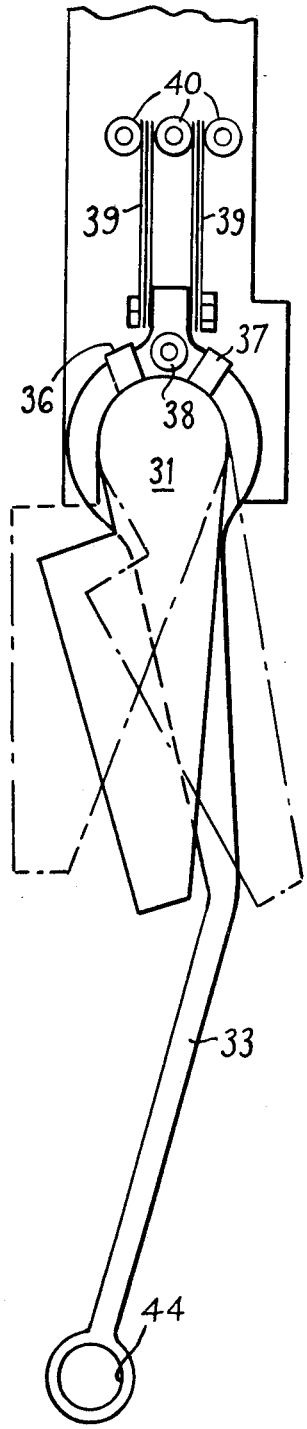
Fig.5

MACHINES FOR APPLYING BAGS OR SACKS TO THE DISCHARGE SPOUTS OF BAG-FILLING MACHINES

BACKGROUND OF THE INVENTION

The present invention relates to the machine for applying bags or sacks to the discharge spouts of bag filling machines. More particularly, the invention relates to bag applying machines having a suction transfer device for advancing a bag towards the discharge spout of a filling machine and comprising opposed suction means for engaging opposite sides of the bag adjacent its mouth, and means for parting said opposed suction means so as to open the bag mouth for placing over the discharge spout. The bags or sacks handled by the machines may be made from paper, PVC or other plastics material.

United Kingdom Pat. No. 1439687 describes a bag applying machine comprising a suction pickup device which lifts a bag from a stack of flat bags and turns the bag from the horizontal position into a substantially vertical position, with its mouth disposed along one vertical side edge of the bag, and a suction transfer device which engages the bag held by the pick-up device, advances the bag from the pick-up device into an upright position adjacent the discharge spout of a bag filling machine, with the bag mouth uppermost, and opens the bag mouth for placing over the discharge spout. The pick-up device comprises a pair of pick-up arms rockable about a horizontal axis and carrying suction cups for gripping a bag. The stack of bags to be fed to the machine is disposed to one side of the machine and the pick-up arms rock downwardly to engage the suction cups with the top bag in the stack. Suction is thereupon applied to the cups so that they grip the bag and the arms are swung upwardly in a vertical arc to move the bag from the horizontal position, in which it is removed from the stack, into a substantially vertical position with its mouth disposed along one vertical side edge of the bag. In this position, the bag is gripped adjacent its mouth by the suction transfer device which comprises a pair of transfer arms pivoted on a horizontal axis ar right angles to the pivot axis of the pick-up device and having pairs of opposed suction cups for engaging opposite sides of the bag. Suction is applied to the transfer suction cups, which grip the bag, and is removed from the pick-up suction cups, which release the bag, and the transfer device then swings upwardly to remove the bag from the pick-up device and advance it to the discharge spout of the bag filling machine. At the same time, the transfer arms are moved apart so that the mouth of the bag is opened and placed over the discharge spout.

With a transfer device as described in the aforementioned specification, and other known types of transfer device, the open mouth of the bag is not formed to a satisfactory configuration for presentation to the discharge spout of the filling machine and, frequently, results in failure of the mouth to slip over the spout, or incorrect positioning on the spout, and improper operation of the filling process. Moreover, because the pick-up device comprises arms which swing in a vertical arc in order to turn the bag into a substantial vertical position for engagement by the transfer device, the pick-up device cannot commence its next cycle until the bag has been removed from its path of movement by the transfer device, thereby reducing the speed of operation of the machine. Moreover, only one pickup device can be provided for feeding the transfer device.

SUMMARY OF THE INVENTION

It is an object of the present invention to provide a bag applying machine having a suction transfer device which is adapted to open the mouth of a bag advanced by the device and to form the open bag mouth into a satisfactory configuration for placing over the discharge spout of a filling machine so that bags are systematically placed in the correct position on the discharge spout. To this end, according to the invention, the suction means of the transfer device comprises opposed main suction members arranged to engage a bag adjacent one end of its mouth and pivotally mounted so as to be rockable apart to open the mouth of the bag, and opposed auxilliary suction members rockably mounted about the pivot axes of the main suction members and arrange to engage the bag adjacent its mouth at positions spaced from said main suction members, said auxilliary suction members being rockable apart together with the main suction members to assist opening of the bag mouth.

With this invention, when the suction members are moved apart so as to open the bag mouth, they form the open mouth into a generally oval configuration which facilitates placing of the mouth over the discharge spout of the filling machine.

A bag applying machine embodying this invention may include a suction pick-up device arranged to lift the bag from a stack of flat bags and turn the bag from the horizontal position, in which it is removed from the stack, to a substantially vertical position with its mouth disposed along one vertical side edge of the bag. The transfer device is arranged to engage the bag held by the pick-up device in this substantially vertical position and advance the bag from the pick-up device for placement over the discharge spout of the filling machine. Preferably the pick-up device is reciprocable substantially vertically for lifting the bag from the stack and includes suction means for gripping the bag, which is rockable about a substantially horizontal axis so as to turn the bag into the vertical position preparatory to engagement by the transfer device. With such a pick-up device, when the bag has been gripped by the transfer device and released by the pick-up suction means, the pick-up device can immediately commence its next cycle and travel downwardly to lift a succeeding bag from the stack, thereby enabling the speed of operation of the machine to be increased. The pick-up device may be reciprocable along a path disposed to one side of the vertical plane of movement of the transfer device and the pick-up suction means may be arranged to turn the bag substantially into said plane of movement so as to permit the bag to be engaged by the transfer device. The speed of operation of the bag applying machine may be further increased by arranging two such pick-up devices on opposite sides of the plane of movement of the transfer device, the two pick-up devices operating alternately to lift bags from two stacks for successive feeding to the transfer device.

The source of suction for the pick-up and transfer devices is preferably a blower unit, such as a side-channel blower, which produces a high degree of suction and a high volume flow of air. This is preferred to a vacuum pump, which produces a higher degree of vacuum but a lower volume air flow because the latter is unable to compensate for small leaks which may occur in the suction system. The suction may be applied to the devices via ducts comprising or extending through hollow casings forming the machine frame.

The stack of bags may be contained in a fixed magazine on the machine, which magazine can be refilled by hand. Alternatively, stacks of bags may be loaded onto trolleys which can be wheeled into a position beneath the pick-up device and can be changed when necessary. In a further alternative, the machine is fed with stacks of bags by a pneumatic system operating a magazine supply to the machine. This system is arranged to slide an empty magazine from under the pick-up device and feed a loaded magazine onto the machine in its place. The empty magazine is then clear of the machine for refilling whilst the machine is removing bags from the loaded magazine. Moreover, such a pneumatic system permits the use of several magazines loaded with different size bags and the system can be selectively operated to load the machine with a magazine containing the size of bag required for filling.

BRIEF DESCRIPTION OF THE DRAWINGS

In order that the present invention may be more readily understood, reference will now be made to the accompanying drawings, in which:

FIG. 4 is a perspective view illustrating details of the main suction members, FIG. 5 is a fragmentary view of the transfer device illustrating details of the coupling between a main suction member and the arm supporting the associated auxilliary suction member.

DETAILED DESCRIPTION OF THE PREFERRED EMBODIMENT

Figure 1:
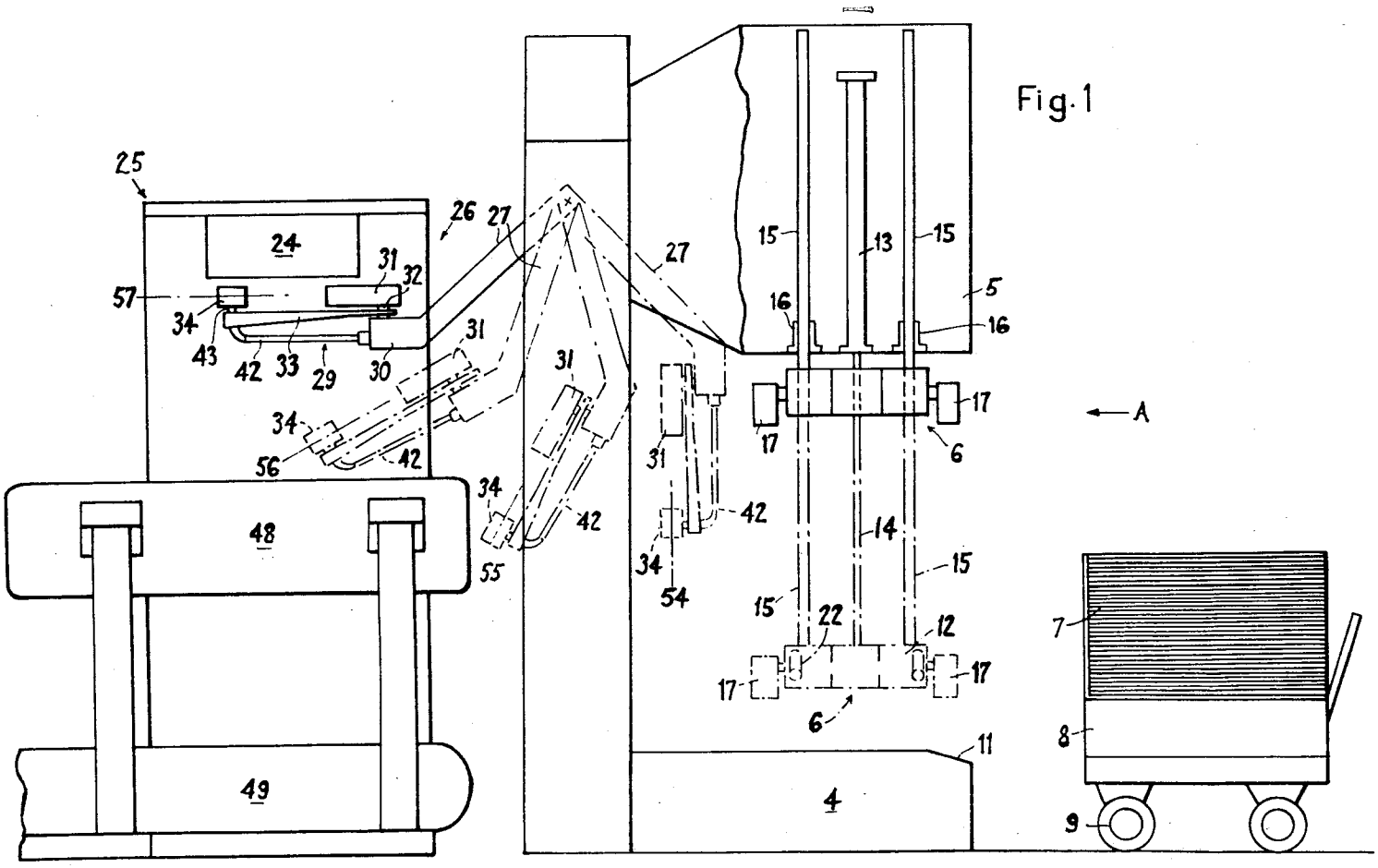
FIG. 1 is a side elevation of one embodiment of the invention and adjacent parts of a bag filling machine.
Figure 2:
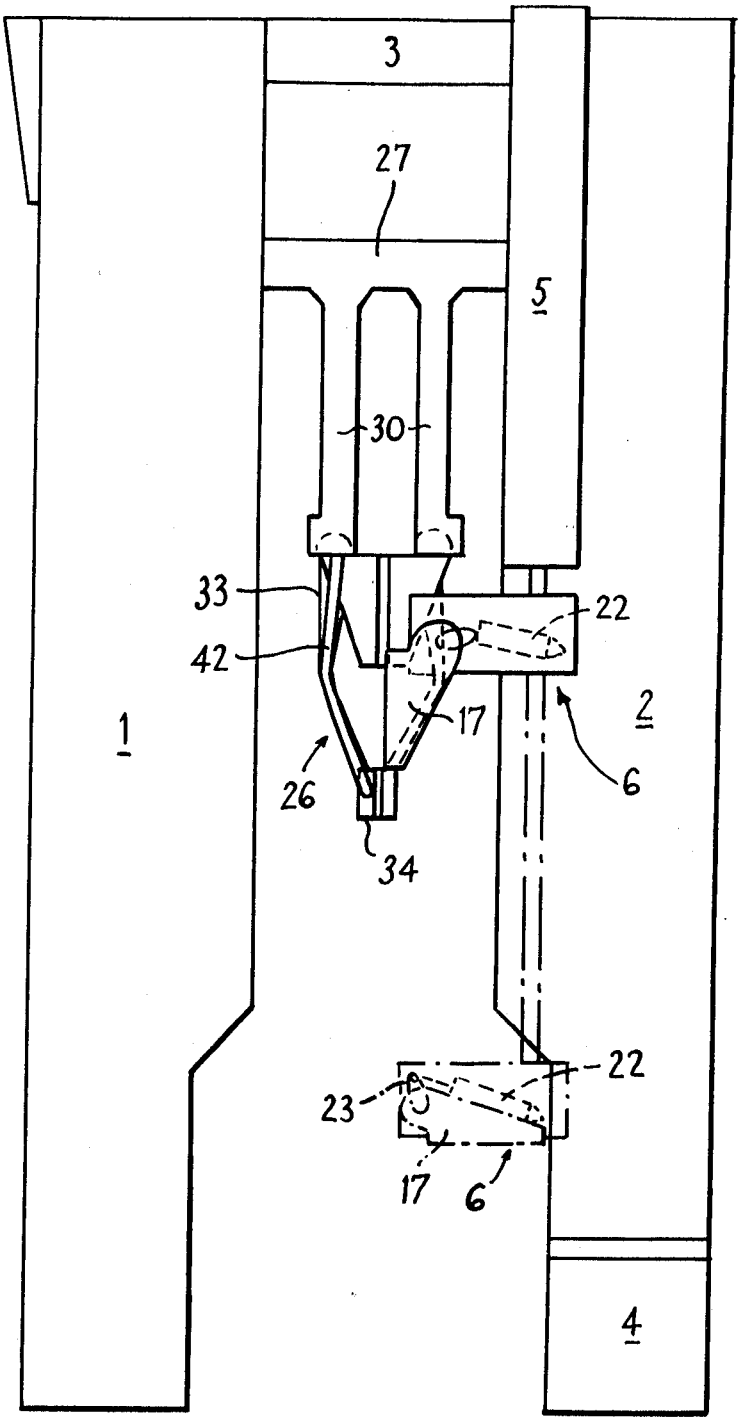
FIG. 2 is an end elevation of the bag applying machine from the direction of the arrow A in FIG. 1.
Figure 3:
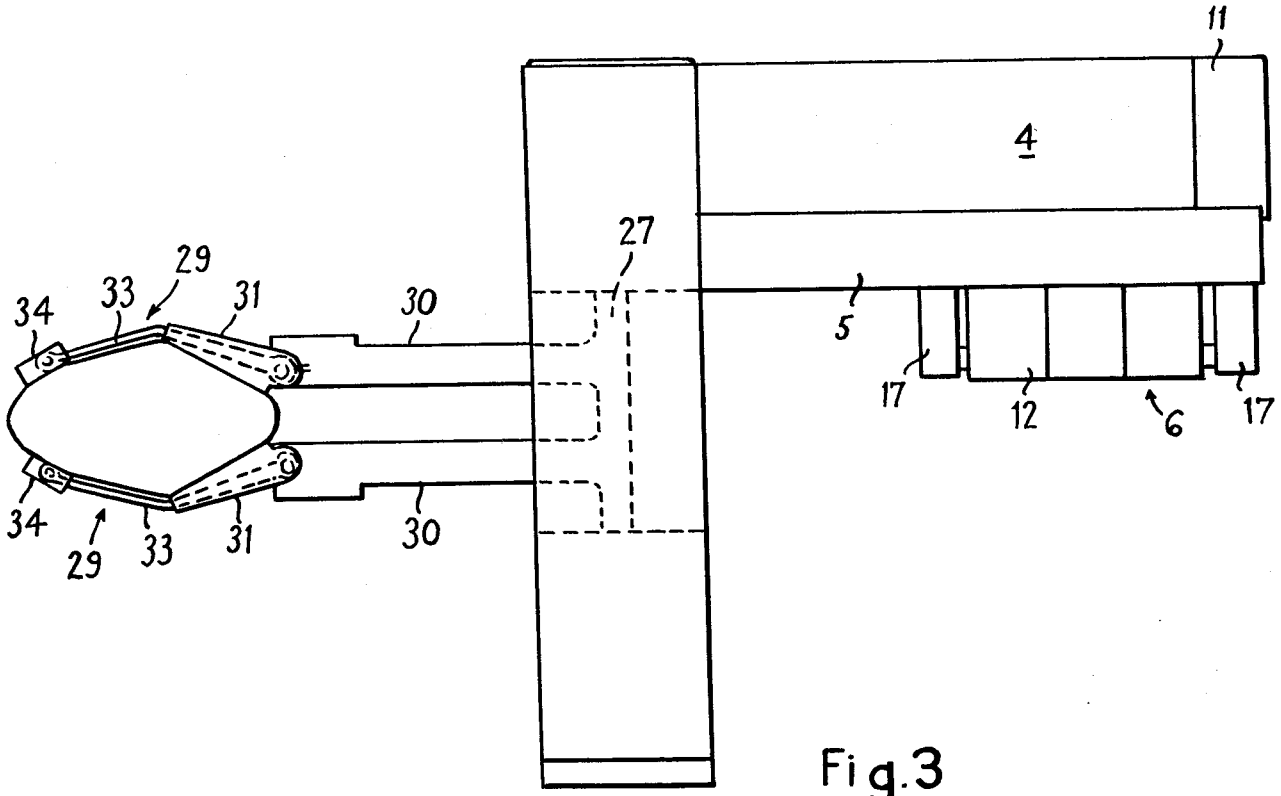
FIG. 3 is a plan view of the bag applying machine shown in FIG. 1.

Referring to FIGS. 1, 2 and 3 of the drawings, the bag applying machine comprises a frame consisting of two upright casings 1, 2 disposed side-by-side in spaced relation and interconnected at their upper ends by a hollow bridge part 3. A horizontal support casing 4 projects from the foot of the upright casing 2. These casings may be prefabricated from sheet metal.

Secured to the casing 2 adjacent its upper end and projecting outwardly above the support casing 4 is a flat suction tank 5 which supports a suction pick-up device 6 for removing bags from a stack of flat bags 7 disposed one on top of another and, in this case, carried on a trolley 8. This trolley has large castors 9 which permit easy movement of the trolley over rough floor areas as the trolley is wheeled to the machine. The trolley is adapted to straddle the hollow support casing 4 which guides the trolley into the correct position under the pick-up device 6. The trolley includes small internal wheels 10, schematically illustrated in FIG. 6, which assist in accurately guiding the trolley onto the support casing. Moreover, small additional wheels (not shown) on the underneath of the trolley ride-up the inclined leading edge 11 of the support casing 4, lift the larger running castors 9 off the floor and level the trolley at the correct height for removal of bags from the stack.

The pick-up device 6 comprises a pick-up box 12 which is reciprocated vertically by means of a pneumatic cylinder and piston unit 13 mounted within the suction tank 5 and having its piston rod 14 connected to the pick-up box. The latter is guided by two hollow guide rods 15 which are secured to the box 12 and are slidable in sleeves 16 secured to the inside of the bottom of the suction tank. At their lower ends, the internal bores of the guide rods are in communication with the interior of the box 12 whilst at their upper ends they open into the suction tank 5.

Mounted at opposite ends of the pick-up box 12 so as to be rockable about horizontal axes, are two elongated pick-up suction members or fingers 17. These pick-up fingers are more fully illustrated in FIG. 4. Each finger is of hollow box-like construction and is of somewhat triangular shape in elevation. A hollow pivot shaft 18 is secured to the finger adjacent its wider end and its bore communicates with the interior of the hollow finger. The finger has a planar suction face defined by a grill 19 having slots 20 communicating with the interior of the finger. The suction face is provided with an elastomeric sealing element 21, conveniently a soft rubber sealing element, which projects proud of the suction face. In operation, the suction draws the fabric of a bag against the rubber sealing element, and this provides friction to hold the bag in place whilst it is being manoeuvred by the suction finger.

As illustrated in FIGS. 1, 2 and 3, the hollow pivot shaft 18 of each suction finger is journalled in the adjacent end of the pick-up box 12 and connects the interior of the box with the interior of the associated suction finger so that suction applied to the tank is also applied to the fingers 17 via the hollow rods 15 and the pick-up box. The suction fingers are actuated by individual pneumatic cylinder and piston units 22 mounted within the pick-up box 12 and connected to crank arms 23 fixed to the pivot shafts 18 of the fingers. The pneumatic units 22 are operable in unison in order to rock the fingers between two positions in which the suction faces 19 of the fingers are respectively horizontal and vertical (see FIG. 2). Hence, with the pick-up fingers rocked into the positions in which the suction faces are horizontal, the pick-up device can be lowered so as to engage the fingers with the top bag on the stack 7. (The lowermost position of the pick-up device is illustrated in broken lines in FIGS. 1 and 2). The top bag is attached to the fingers by the application of suction, via the suction tank 5, and can be lifted from the stack, upon upward travel of the pick-up device, and turned from the horizontal position in which it is removed from the stack into a vertical position by rocking the suction fingers 17 into the positions in which the suction faces 19 are vertical, as the pick-up device is raised to its uppermost position (full lines in FIGS. 1 and 2.) In this position, the bag hangs from the fingers in a substantially vertical plane or position with its mouth at the side edge of the bag adjacent the upright casings 1, 2.

The bag lifted and turned by the pick-up device 6 is carried to the discharge spout 24 of the bag filling machine 25 by a suction transfer device 26. The latter comprises a swinging arm 27 suspended between the upright casings 1 and 2 and having trunnions 28 journalled in these upright casings. The swinging arm is a bifurcated member and has opposed suction operated, bag-holding means 20 mounted at the lower ends of its limbs 30 for engaging, adjacent its mouth, a bag lifted by the pick-up device, and for transferring the bag from the pick-up device to the spout 24. During this transfer step, the suction means 29 are moved apart, as will hereinafter be described, to open the mouth of the bag and the swinging arm swings the bag into an upright position with its mouth uppermost for placing over the filling spout.

Each suction means 29 includes an elongated suction member in the form of a suction finger 31 identical to the suction fingers 17 and having its hollow pivot shaft 32 journalled in the lower end of the associated limb 30 of the swinging arm. The two suction fingers 31 carried by the limbs 30 are disposed with their suction faces in opposed relation and are arranged so that when the suction means are fully closed together with no bag therebetween, the suction faces of the fingers are mutually parallel and in contact, via their rubber sealing elements. Freely pivoted on the pivot shaft 32 of each finger 31 is a spring-biassed arm 33 which projects forwardly of the associated finger and has an auxilliary suction member in the form of a suction box 34 rockably mounted at its free end in spaced relation with the assoicated suction finger. The suction boxes 34 are mutually opposed and of similar construction to the suction fingers. When the suction means 29 fully close together without a bag therebetween, the suction faces of the boxes 34 are in contact via their rubber sealing elements. Each arm 33 is coupled to its associated suction finger 31, so as to be rockable therewith over a predetermined arc of movement, via a lost motion coupling. As illustrated in FIG. 5, the latter comprises a pair of abutments 36, 37 projecting in spaced relation from the suction finger 31 adjacent its pivot shaft and arranged alternatively to engage a small roller 38 mounted on the arm 33 between the abutments. The arm is biassed towards a central position by leaf springs 39 fastened to the arm and engaged between three rollers 40 mounted on the associated limb 30 of the swinging arm. The arrangement is such that each abutment 36 engages the adjacent roller 38, when the suction fingers 31 are rocked towards the closed position, in order positively to close together the suction boxes 34, and each abutment 37 engages the adjacent roller 38 upon opening of the suction fingers in order positively to drive the suction boxes to an open position during the final arc of opening movement of the suction fingers. Intermediate these two stages, there is a position where the suction fingers move independently of the arms 33, and hence the suction boxes, which are thereupon resiliently controlled by the leaf springs 39.

Suction is applied to the suction fingers 31 and boxes 34 via the swinging arm 27 which is of hollow construction. The pivot shafts 32 of the suction fingers are in communication with the hollow interiors of the associated limbs 30 of the swinging arm, whilst the suction boxes 34 are connected to these limbs via pipes 42 fastened by suitable couplings to the ends of hollow pivot shafts 43 of the suction boxes, which shafts are journalled in collars 44 at the free ends of the supporting arms 33.

Figure 6:
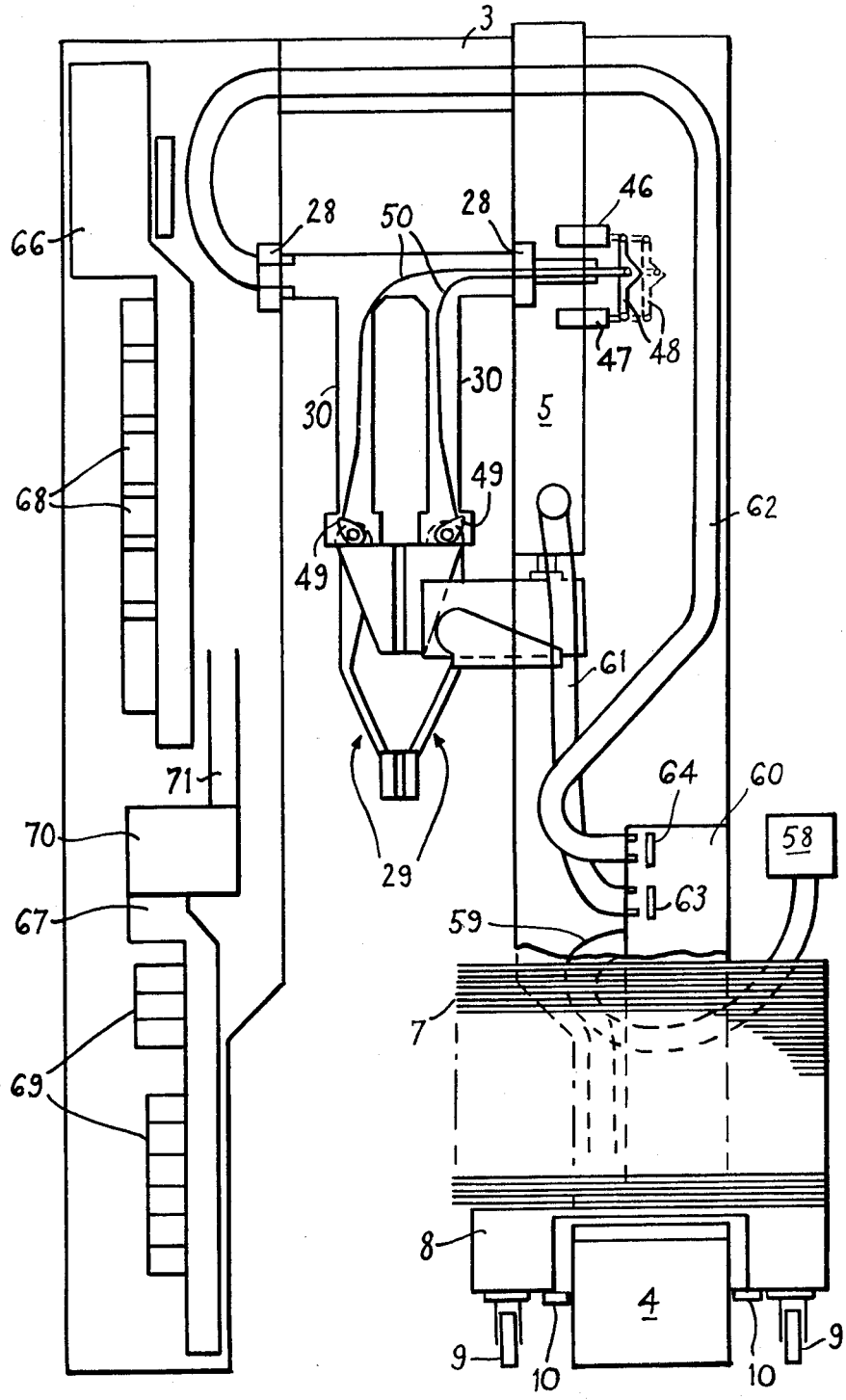
FIG. 6 is an end elevation with walls of the machine casings broken away to illustrate the interiors of the casings.
Figure 7:
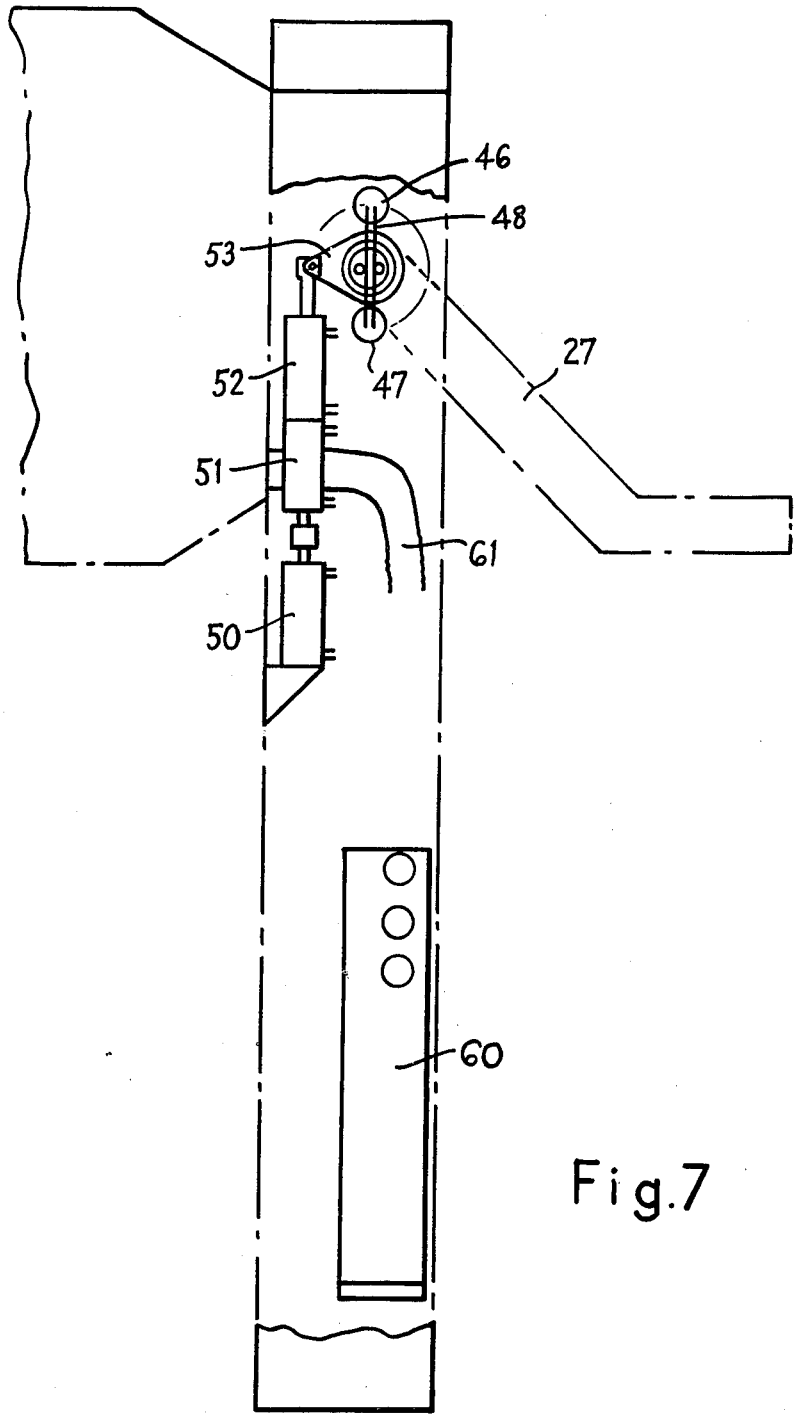
FIG. 7 is a fragmentary side elevation with the adjacent casing wall broken away to show further details of the interior of the casing.

The rocking movement of the suction fingers 31, and hence the suction boxes 34, is controlled by a pneumatic cylinder assembly mounted in the upright casing 2. Referring to FIGS. 6 and 7, this assembly comprises a pair of pneumatic cylinder and piston units 46, 47 mounted side-by-side and having their piston rods interconnected by a yoke member 48 which is pivoted to each piston rod. The centre of the yoke member 48 is connected to crank arms 49 fixed to the pivot shafts 32 of suction fingers 31 by two rods of cables, in this case Bowden cables 50, extending through the adjacent trunnion 28 of the swinging arm and the hollow limbs 30 of the arm. This assembly moves the suction fingers 31 in unison. When the pistons of both units 46, 47 are fully retracted the suction fingers and boxes are fully closed together. When both pistons are fully extended, the suction boxes and fingers are in their fully open position. When either one or other piston is extended and the other is retracted, the suction fingers and boxes are in a half-open position. The latter position permits the suction assemblies 29 to pass between the guide boards 48 of the conveyor mechanism 49 associated with the filling spout, during the return stroke of the swinging arm.

The swinging arm 27 is moved between predetermined stations over its arc of movement by means of three pneumatic cylinder and piston units 50, 51, 52 connected in series (FIG. 7). These are mounted within the upright casing 2 and are connected between the casing and a crank arm 53 secured to the adjacent trunnion 28 of the swinging arm. The three series connected pneumatic units 50, 51, 52 are actuated in a predetermined sequence to rock the swinging arm through the following stations during each transfer cycle. At the start of the said transfer cycle, the arm is rocked to a collecting station 54, at which it engages a bag carried by the pick-up device 6. The arm is then advanced to a ready station 56, at which the suction means 29 are fully opened to open the mouth of the bag preparatory to placing it over the filling spout 24, and subsequently to a bag clamping station 57, at which the bag mouth is placed over and clamped to the filling spout. At this latter station, the pneumatic units 50, 51, 52 are fully retracted, as illustrated in FIG. 7. During the return stroke of the swinging arm, the pneumatic units rock the swinging arm from the bag clamping station back to the ready station 56, during which period the suction means 29 are half closed together, and thereafter to a nearvertical, rest station 55 in which the swinging arm is stopped preparatory to commencing the next transfer cycle.

The source of suction for the machine is a sidechannel blower 58, which is connected by a duct 59 to a cleaning box 60 mounted within the upright casing part 2. The cleaning box 60 has a removable bottom (not shown) so as to allow for removal of dirt sucked into the system through both sets of suction means and deposited in the cleaning box. The suction tank 5 is connected to the cleaning box 60 by a duct 61 extending through the upright casing 2. A duct 62 extending through the upright casing 2, the hollow bridge part 3 and coupled to the hollow trunnion 28 within the casing part 1 connects the interior of the hollow swinging arm 27, and hence the suction means 29 to the cleaning box. Both ducts 61, 62 are connected to the cleaning box via valves 63, 64, respectively.

The electrical and pneumatic control systems 66, 67, respectively, for the machine are mounted within the upright casing 1 and comprise plug-in modules so that the electrical control relays 68 and the pneumatic valves 69 controlling the supply of air pressure to the various pneumatic cylinders can be readily changed by merely unplugging a defective component and replacing it with a new component. The pneumatic control module is connected to a pneumatic junction box 70 having plug-in connections for the pneumatic pipes 71 connecting the module to the pneumatic cylinders.

Under the control of the electrical and pneumatic systems, the sequence of operations of the machine is as follows. Upon switching-on the electrical mains supply to the machine, the blower 58 is started and the following sequence of operations occurs:

(a) the air valves 63, 64 are opened,
(b) the swinging arm 27 is positioned in its rest station 55 with the suction holding means 29 in the half-open position,
(c) the pick-up device 6 travels to its uppermost position and the suction pick-up fingers 17 are positioned horizontally.

A trolley 8 loaded with a stack of paper or plastics bags to be filled is moved onto the support casing 4, the mouths of the bags being adjacent the upright casings 1, 2. A microswitch is located in a suitable position on the casings to detect the presence of a stack of bags in position on the machine, and, if absent, prohibits the machine from operating. With the stack of bags in position, the operator initiates automatic operation of the machine by depressing a cycle start switch, whereupon the air valves 63, 64 are closed and air pressure is applied to the pneumatic cylinder 13 so as to drive the pick-up box 12 downwardly until a microswitch on the bottom of the box touches the top bag of the stack loaded onto the machine. When this bottom microswitch is actuated, the following sequence of operations occurs:

(a) the air valve 63 is opened to apply suction to the suction fingers 17, via the suction tank 5 and the guide rods 15, so that the top bag is gripped to the suction fingers,
(b) air pressure is applied to the cylinder 13 to raise the suction box 12 together with the bag gripped thereto,
(c) air pressure is applied to the pneumatic cylinders 22 so that the fingers and the bag are turned into the vertical position as the suction box travels upwardly.

When the suction box 12 reaches its uppermost position, the bag has been turned into a vertical position or plane with its mouth disposed along the end or side edge of the bag adjacent the upright casings. A microswitch on top of the box is then actuated and this checks with a suction switch within the suction box to detect that a bag is in place. In the affirmative, these two switches provide a signal to initiate movement of the swinging arm 27 to the collecting station 54. The swinging arm is rocked into the collecting station by actuation of one or more of the pneumatic cylinders 50, 51, 52 and, at the same time, the suction holding means 29 are rocked into their fully open position. In the collecting station, a first microswitch associated with the swinging arm trunnions 28 is actuated to cause air pressure to be applied to the cylinders 46, 47 so as fully to retract their piston rods and cause the suction means 29 to close together and grip the bag adjacent its mouth. The suction fingers 31 grip the bag held by the pick-up device over an extended zone adjacent the upper end of the bag mouth, whilst the suction boxes 34 grip the bag adjacent the lower end of the mouth. Thereupon, a first microswitch associated with one of the suction fingers 31 is actuated which initiates the following sequence of operations:

(a) the air valve 64 is opened so as to apply suction to the suction means 29,
(b) the air valve 63 is closed so as to shutoff suction to the pick-up device and cause the latter to release the bag,
(c) the pneumatic cylinders 50, 51, 52 are actuated to commence the forward stroke of the swinging arm,
(d) the pneumatic cylinders 22 are actuated so as to turn the suction pick-up fingers 17 into their horizontal positions and the cylinder 13 is actuated so as to commence downward travel of the pick-up device for picking-up the next bag on the stack.

The above sequence of operations will only be initiated in response to actuation of the first microswitch associated with the fingers 31 after a predetermined time delay controlled by the electrical control system, which time delay is sufficient to permit the preceding full bag to be moved away from beneath the discharge spout after the bag clamps have released the bag onto the conveyor mechanism 49.

The swinging arm 27 with the bag gripped between the suction means 29 is now rocked by actuation of the pneumatic cylinders 50, 51, 52 into the ready station 56, this movement swinging the bag towards an upright position with its mouth uppermost. A second microswitch associated with the swinging arm trunnions 28 detects when the swinging arm is at the ready station and is connected in series with a suction switch responsive to suction within the swinging arm to detect that a bag is carried by the suction means at this station. In the affirmative, the pneumatic cylinders 46, 47 are actuated so as to extend their piston rods and fully open the suction means 29, thereby to form the mouth of the bag into a generally oval shape for placing over the spout (see FIG. 3,) and a second microswitch associated with the suction fingers 31 actuates the pneumatic cylinders 50, 51, 52 to complete the forward stroke of the swinging arm and place the open mouth of the bag over the discharge spout 24. Movement of the swinging arm into the bag clamping station 57 actuates a third microswitch associated with the swinging arm trunnions which signals the existing bag clamp electrical circuit to close the bag clamp and grip the bag to the discharge spout. Closure of the bag clamp is detected by a microswitch on the spout and when this microswitch is actuated to indicate that the bag is clamped to the spout, the following sequence of operations occurs:

(a) the air valve 64 is closed to shut-off suction to the swinging arm,
(b) the pneumatic cylinders 50, 51, 52 are actuated to return the swinging arm to the rest station 55,
(c) as the swinging arm commences its return stroke, one of the pneumatic cylinders 46 or 47 is actuated in order to half close the suction assemblies 29 so that they freely move between the guide boards 48 of the conveyer,
(d) a fourth microswitch associated with the swinging arm trunnions and connected in the weighing circuit of the bag filling machine prevents commencement of the bag filling operation until the swinging arm has moved away from the bag.

The swinging arm 27 is retained at rest in station 55 until the top microswitch on the suction box 12 again detects that the pick-up device has returned to its uppermost position carrying a fresh bag, whereupon the cycle of operations is automatically repeated, and so on until the stack of bags has been used-up or the machine is prematurely stopped by actuation of a suitable switch.

Whilst a particular embodiment has been described, it will be understood that various modifications can be made without departing from the scope of the invention as defined by the appended claims. For example, in order to increase the speed of operation of the machine a second suction tank and pick-up device may be mounted on the upright casing 1 parallel to the suction tank 5 and pick-up device 6. This second pick-up device is arranged to pick-up bags from a stack contained on a trolley or magazine disposed beneath it and successively feed these bags to the transfer device 26 in alternate relation to the first pick-up device 6.

I claim:

1. In a machine for applying a bag to the discharge spout of a bag filling machine, including a transfer device for advancing the bag to the discharge spout, said transfer device comprising opposed suction means for engaging opposite sides of the bag adjacent its mouth, and means for parting said opposed suction means so as to open the bag mouth for placing over the discharge spout, improved suction means comprising:

(a) opposed main suction members arranged to engage the bag adjacent one end of its mouth and pivotally mounted so as to be rockable apart to open said bag mouth, (b) opposed auxiliary suction members pivotally mounted coaxially with the pivot axes of said main suction members and arranged to engage said bag adjacent its mouth at positions spaced from said main suction members, said auxiliary suction members being rockable apart together with said main suction members to assist opening of said bag mouth.

2. A machine as claimed in claim 1, wherein said auxiliary suction members are pivoted on arms which are pivotally mounted coaxially with said main suction members, and coupling means connects said main suction members to said arms so that said arms are rocked in response to rocking movement of said main suction members.

3. A machine as claimed in claim 1, wherein said main and auxiliary suction members are rockable by two fluid-operated cylinder and piston units mounted side-by-side and having their piston rods inter-connected by a yoke member, said yoke member being pivoted to said piston rods and being connected to crank arms secured to the pivots of said suction members by means which is attached to said yoke member intermediate its ends, whereby said suction members can be rocked together, or fully apart, or to an intermediate position by selective actuation of said cylinder and piston units.

4. A machine as claimed in claim 1, wherein said transfer device includes a swinging arm which mounts said main and auxiliary suction members and is at least partially hollow and serves as ducting for connecting said suction members to a source of suction.

5. A machine as claimed in claim 4, wherein said swinging arm is rocked about its swing axis by fluid-operated means, whereby the swinging arm is movable between predetermined stations during each transfer cycle, in which stations the bag is engaged by said suction members, the bag mouth is opened preparatory to placing over the discharge spout, the bag is placed over said discharge spout and released, and said swinging arm is stopped after its return stroke, and prior to commencing the next transfer cycle.

6. A machine as claimed in claim 1, wherein a suction pick-up device is adapted to lift the bag from a stack of flat bags and turn the bag from a horizontal position into a substantially vertical position, with its mouth disposed along one vertical side edge of the bag, and said transfer device is arranged to engage the bag, held by said pick-up device in a substantially vertical position, and advance said bag to said discharge spout, and wherein said suction pick-up device is reciprocable substantially vertically for lifting the bag from the stack, and includes suction means for gripping said bag which is rockable about a substantially horizontal axis so as to turn the bag into said substantially vertical position preparatory to engagement by said transfer device.

7. A machine as claimed in claim 6, wherein said pick-up device is reciprocable along a path disposed to one side of the vertical plane of movement of said transfer device and said pick-up suction means is arranged to turn the bag substantially into said plane of movement, of the transfer device, when it turns said bag into said substantially vertical position, so as to permit the bag to be engaged by said transfer device.

8. A machine for applying a bag to the discharge spout of a bag filling machine comprising in combination:

(a) a suction pick-up device adapted to lift the bag from a stack of flat bags and turn said bag from a horizontal position into a substantially vertical position, with its mouth disposed along one vertical side edge of said bag, (b) said suction pick-up device comprising a suction box and pick-up suction members for gripping said bag pivotally mounted on said suction box for rocking movement about a substantially horizontal axis, whereby said suction members are rockable to turn said bag gripped thereby into said substantially vertical position, (c) fluid-operated means operatively connected to said suction box for reciprocating said suction box in a substantially vertical direction for lifting said bag from said stack, (d) at least one hollow guide rod for guiding said suction box for vertical reciprocating movement, (e) said at least one hollow guide rod also comprising means via which suction is applied to said suction box and, hence, said pick-up suction members, and (f) a suction transfer device arranged to engage said bag, held by said pick-up device in said substantially vertical position, advance said bag from said pick-up device into a substantially upright position, in which its mouth is uppermost, and open said bag mouth for placing over said discharge spout.

9. A machine as claimed in claim 8, wherein the or each hollow guide rod is slidably mounted at its upper end in a suction tank which is connectable to a source of suction, and said pick-up suction members are connected to said suction tank via said pick-up box and said hollow guide rod(s).

10. A machine as claimed in claim 8, wherein said suction box is vertically reciprocable along a path disposed to one side of the vertical plane of movement of said transfer device, and said pick-up suction members are arranged to turn said bag substantially into said plane of movement of said transfer device, when it turns said bag into said substantially vertical position, so as to permit said bag to be engaged by said transfer device.

11. A machine for applying a bag to the discharge spout of a bag filling machine, comprising:

(1) a suction pick-up device adapted to lift a bag from a stack of flat bags and turn the bag from a horizontal position into a substantially vertical position, with its mouth disposed along one vertical side edge of the bag, said pick-up device including (a) suction means for gripping said bag pivoted for rocking movement about a substantially horizontal axis, (b) first actuating means for reciprocating said pivoted suction means along a substantially vertical path for lifting the bag from said stack, (c) second actuating means for rocking said suction means about said horizontal pivot axis to turn the bag lifted by said suction means into said substantially vertical position;

(2) a suction transfer device arranged to engage the bag, held by said pick-up device in a substantially vertical position, and transfer it into a substantially upright position with its mouth open and uppermost for placing over the discharge spout of a filling machine;

(3) means mounting said transfer device for swinging movement about a substantially horizontal axis substantially perpendicular to said pivot axis of said pick-up suction means;

(4) third actuating means for swinging said transfer device to transfer the bag from said pick-up device into said substantially upright position;

(5) said suction transfer device including (a) opposed suction fingers arranged to engage the bag held by the pick-up device adjacent the upper end of its mouth and pivotally mounted so as to be rockable apart, (b) opposed auxiliary suction members rockably mounted on arms pivotally mounted coaxially with said suction fingers and arranged to engage the bag adjacent the lower end of its mouth;

(6) fourth actuating means for rocking said suction fingers and said auxiliary suction members apart upon swinging of the bag into said upright position, whereby to open the bag mouth preparatory to placing over the discharge spout;

(7) a blower unit connected to apply suction to said pick-up suction means, suction fingers and auxiliary suction members;

(8) control means for controlling said actuating means and said application of suction to cause the bag to be successively moved by said pick-up and transfer devices from said stack to said upright position.

* * * * *